US010400768B2

(12) United States Patent
Sakai et al.

(10) Patent No.: US 10,400,768 B2
(45) Date of Patent: Sep. 3, 2019

(54) FUEL PUMP AND MANUFACTURING METHOD THEREOF

(71) Applicant: DENSO CORPORATION, Kariya, Aichi-pref. (JP)

(72) Inventors: Hiromi Sakai, Kariya (JP); Daiji Furuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 281 days.

(21) Appl. No.: 15/544,345

(22) PCT Filed: Jan. 15, 2016

(86) PCT No.: PCT/JP2016/000189
§ 371 (c)(1),
(2) Date: Jul. 18, 2017

(87) PCT Pub. No.: WO2016/117316
PCT Pub. Date: Jul. 28, 2016

(65) Prior Publication Data

US 2018/0010607 A1 Jan. 11, 2018

(30) Foreign Application Priority Data

Jan. 23, 2015 (JP) ..... 2015-11466

(51) Int. Cl.

| | |
|---|---|
| ***F04C 15/06*** | (2006.01) |
| ***F02M 37/08*** | (2006.01) |
| ***F04C 2/10*** | (2006.01) |
| ***F04C 15/00*** | (2006.01) |

(52) U.S. Cl.
CPC ..... *F04C 15/06* (2013.01); *F02M 37/08* (2013.01); *F04C 2/102* (2013.01); *F04C 15/0049* (2013.01); *F04C 2230/10* (2013.01); *F04C 2240/30* (2013.01); *F04C 2250/10* (2013.01)

(58) Field of Classification Search
CPC ..... F04C 15/06; F04C 2250/10; F04C 2/102
See application file for complete search history.

(56) References Cited

U.S. PATENT DOCUMENTS

2013/0089453 A1 4/2013 Ogata et al.

FOREIGN PATENT DOCUMENTS

| | | |
|---|---|---|
| JP | 2008-274870 | 11/2008 |
| JP | 2012-197709 | 10/2012 |

OTHER PUBLICATIONS

International Search Report for PCT/JP2016/000189, dated Apr. 5, 2016, 4 pages.

*Primary Examiner* — Mary Davis
(74) *Attorney, Agent, or Firm* — Nixon & Vanderhye PC

(57) ABSTRACT

A suction side end part of a suction guide passage and a discharge side end part of a discharge guide passage are opposed to each other with a gap therebetween. At a deviation angle at which contraction of a pump chamber starts, an outer peripheral part of the discharge side end part is formed along an inner tooth, and an inner peripheral part of the discharge side end part is formed along an outer tooth. A working tool that rotates and cuts circularly is moved around on a pump housing in a single continuous line to form an outline of the discharge guide passage, thereby forming the discharge guide passage. The working tool is moved around on the pump housing in a single continuous line to form an outline of the suction guide passage, thereby forming the suction guide passage.

4 Claims, 7 Drawing Sheets

FUEL PUMP AND MANUFACTURING METHOD THEREOF

CROSS REFERENCE TO RELATED APPLICATION

This application is the U.S. national phase of International Application No. PCT/JP2016/000189 filed Jan. 15, 2016, which designated the U.S. and claims priority to Japanese Patent Application No. 2015-11466 filed on Jan. 23, 2015, the entire contents of each of which are hereby incorporated herein by reference.

TECHNICAL FIELD

The present disclosure relates to a fuel pump that draws fuel sequentially into pump chambers and then discharges fuel and to a method of manufacturing the fuel pump.

BACKGROUND ART

Patent Document 1 discloses an oil pump for the art applicable to a fuel pump that draws fuel into pump chambers and then discharges fuel in succession. This pump includes an outer gear having inner teeth, an inner gear that includes outer teeth and is eccentric relative to the outer gear in an eccentric direction to be engaged with the outer gear, and a pump housing that accommodates the outer gear and the inner gear to be rotatable in the circumferential direction. The outer gear and the inner gear rotate to draw oil into the pump chambers and then discharge oil in succession, with the volume of the pump chambers formed between both these gears increased or decreased.

This pump housing includes a sliding surface on which the outer gear and the inner gear slide, and a suction guide passage that suctions oil into the pump chamber and a discharge guide passage that discharges oil from the pump chamber as guide passages that are recessed from this sliding surface to extend in the circumferential direction. A suction side end part of the suction guide passage and a discharge side end part of the discharge guide passage are opposed to each other with a gap therebetween.

The pump chamber between the suction side end part and the discharge side end part forms a chamber which is a gap having a closed shape.

PRIOR ART DOCUMENT

Patent Document

Patent Document 1: JP2008-274870A

Patent Document 1 seems to set the shape of the discharge side end part not to prevent the formation of this chamber. Thus, for example, the distance between the outer peripheral part of the suction side end part and the outer peripheral part of the discharge side end part is short relative to an intermediate part. There is concern that, when this configuration is applied to a fuel pump, fuel leaks from the discharge guide passage into the suction guide passage via the sliding surface and the pump efficiency consequently reduces.

SUMMARY OF INVENTION

The present disclosure addresses the above-described issues. Thus, it is an objective of the present disclosure to provide a fuel pump with high pump efficiency and a manufacturing method thereof.

To achieve the objective, a fuel pump in an aspect of the present disclosure includes: an outer gear that includes a plurality of inner teeth; an inner gear that includes a plurality of outer teeth and is eccentric from the outer gear in an eccentric direction to be engaged with the outer gear; and a pump housing that rotatably accommodates the outer gear and the inner gear. The outer gear and the inner gear expand and contract volume of a plurality of pump chambers formed between both the gears, and rotate to sequentially suction fuel into the plurality of pump chambers and discharge fuel from the plurality of pump chambers. The pump housing includes: a sliding surface on which the outer gear and the inner gear slide; a suction guide passage that suctions fuel into the plurality of pump chambers as a guide passage that is recessed from the sliding surface and extends in a circumferential direction of the pump housing; and a discharge guide passage that discharges fuel from the plurality of pump chambers as the guide passage that is recessed from the sliding surface and extends in the circumferential direction. A suction side end part of the suction guide passage and a discharge side end part of the discharge guide passage are opposed to each other with a gap therebetween. At a deviation angle at which the contraction of each of the plurality of pump chambers starts, an outer peripheral part of the discharge side end part is formed along a corresponding one of the plurality of inner teeth, and an inner peripheral part of the discharge side end part is formed along a corresponding one of the plurality of outer teeth.

In this aspect, the outer peripheral part of the discharge side end part is formed along the inner teeth of the outer gear at the deviation angle at which the contraction of the pump chamber starts. In addition, the inner peripheral part of the discharge side end part is formed along the outer teeth of the inner gear at the deviation angle at which the contraction of the pump chamber starts. As a result of the discharge guide passage including the outer peripheral part and the inner peripheral part, the discharge of fuel into the discharge guide passage is started smoothly when the reduction of the pump chamber starts. Thus, the pulsation is restricted, so that both the gears can smoothly rotate. Moreover, the outer peripheral part and the inner peripheral part of the discharge side end part are located away from the suction side end part with a gap therebetween in the circumferential direction. Consequently, the leakage of fuel from the discharge guide passage via the sliding surface to the suction guide passage can be limited. Therefore, the fuel pump with high pump efficiency can be provided.

According to a method of manufacturing the fuel pump in another aspect of the present disclosure, a discharge guide passage cutting process is performed, in which a working tool that rotates and cuts circularly is moved around on the pump housing in a single continuous line to form an outline of the discharge guide passage including the discharge side end part, thereby forming the discharge guide passage. In addition, a suction guide passage cutting process is performed, in which the working tool is moved around on the pump housing in a single continuous line to form an outline of the suction guide passage including the suction side end part, thereby forming the suction guide passage.

In this aspect, the working tool that rotates and cuts circularly is moved around on the pump housing in a single continuous line to form the outline of the discharge guide passage including the discharge side end part, thereby forming the discharge guide passage. In such a process, the discharge guide passage can be formed without changing the working tool, thereby limiting the development of burr or the like that can be caused in the case of changing the working tool. This can facilitate the production of the fuel pump, in which the outer peripheral part along the inner tooth and the inner peripheral part along the outer tooth are formed. The productivity can be improved by also forming the suction guide passage similarly.

In the fuel pump which is produced in this manner, the fuel smoothly starts to be discharged into the discharge guide passage upon start of the decrease of the pump chamber. Thus, the pulsation is restricted, so that both the gears can smoothly rotate. Moreover, the outer peripheral part and the inner peripheral part of the discharge side end part are located away from the suction side end part with a gap therebetween in the circumferential direction. Consequently, the leakage of fuel from the discharge guide passage via the sliding surface to the suction guide passage can be limited. Therefore, the fuel pump with high pump efficiency can be produce easily.

BRIEF DESCRIPTION OF DRAWINGS

The above and other objects, features and advantages of the present disclosure will become more apparent from the following detailed description made with reference to the accompanying drawings. In the drawings.

EMBODIMENT FOR CARRYING OUT INVENTION

An embodiment will be described below with reference to the accompanying drawings.

Figure 1:
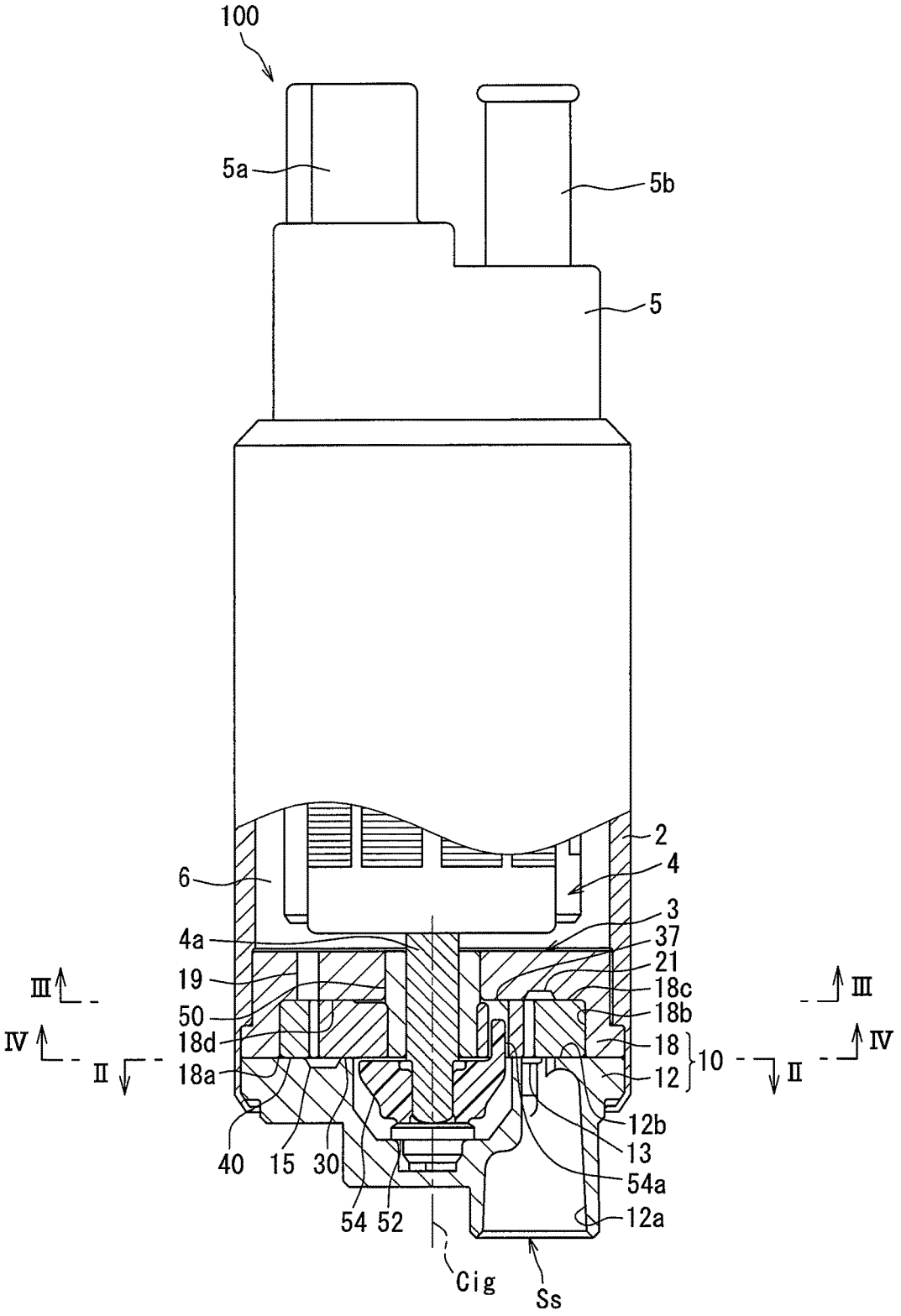
FIG. 1 is a front view illustrating a partial section of a fuel pump in accordance with an embodiment.

As illustrated in FIG. 1, a fuel pump 100 of the embodiment is a positive displacement trochoid pump disposed in a vehicle. The fuel pump 100 includes a pump main body 3 and an electric motor 4, which are accommodated in a cylindrical pump body 2. The fuel pump 100 includes a side cover 5 that projects outward from the end of the pump body 2 on an opposite side of the electric motor 4 from the pump main body 3 in the axial direction. The side cover 5 includes an electric connector 5*a* for energization of the electric motor 4, and a discharge port 5*b* through which to discharge fuel. In this fuel pump 100, the electric motor 4 is rotated by the energization from an external circuit through the electric connector 5*a*. Consequently, the fuel drawn and pressurized by the pump main body 3 using the rotation force of a rotation shaft 4*a* of the electric motor 4 is discharged from the discharge port 5*b*. The fuel pump 100 discharges light oil having higher viscosity than gasoline as fuel.

The pump main body 3 will be described in detail below. The pump main body 3 includes a pump housing 10, an inner gear 30, and an outer gear 40. The pump housing 10 is obtained by stacking a pump cover 12 and a pump case 18.

The pump cover 12 is formed from metal in a disc shape. The pump cover 12 projects outward from the end of the pump body 2 on an opposite side of the electric motor 4 from the side cover 5 in the axial direction.

Figure 2:
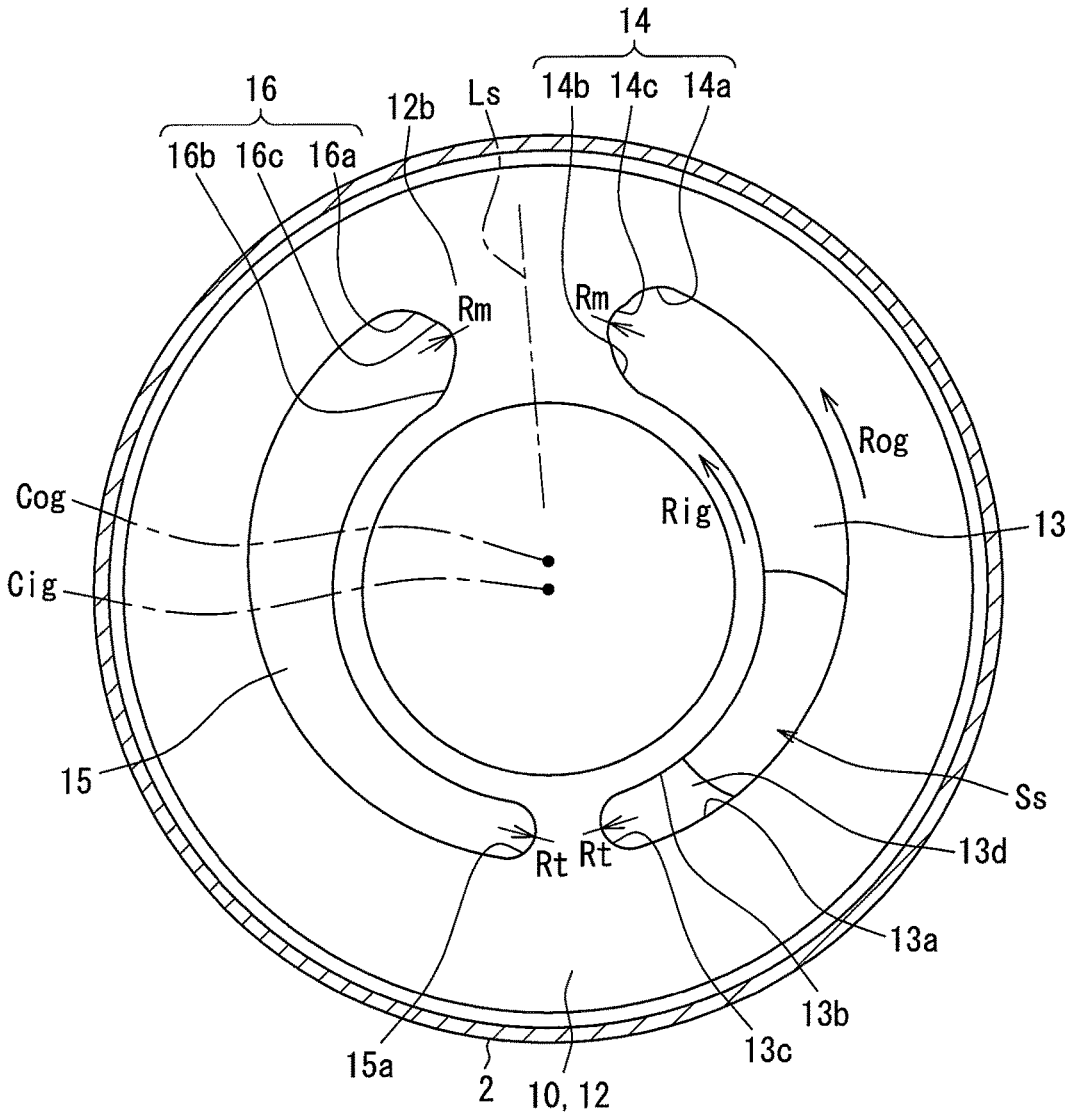
FIG. 2 is a cross-sectional view taken along a line II-II in FIG. 1 illustrating a pump body and a pump housing.

The pump cover 12 illustrated in FIGS. 1 and 2 includes a suction port 12*a* having a cylindrical hole shape, and a suction passage 13 having a circular arc groove shape, for drawing in fuel from the outside. The suction port 12*a* passes through a particular part Ss of the pump cover 12 that is eccentric from the inner central line Cig of the inner gear 30 along the axial direction of the pump cover 12. The suction passage 13 passes through a sliding surface 12*b* of the pump cover 12 on the pump case 18-side along the axial direction to open toward the pump case 18. As illustrated in FIG. 2, an inner peripheral extending part 13*b* of the suction passage 13 extends to have a length smaller than half a circumference along the rotation direction Rig of the inner gear 30 (see also FIG. 4). An outer peripheral extending part 13*a* of the suction passage 13 extends to have a length smaller than half a circumference along a rotation direction Rog of the outer gear 40 (see also FIG. 4).

The suction passage 13 is further widened from a starting end part 13*c* having a circular arc shape toward a suction side end part 14 serving as a terminal part in the rotation directions Rig, Rog. The suction port 12*a* opens at the particular part Ss of a groove bottom part 13*d*, so that the suction passage 13 communicates with the suction port 12*a*. Particularly, as illustrated in FIG. 2, in the entire region of the particular part Ss at which the suction port 12*a* opens, the width of the suction passage 13 is set to be smaller than the diameter of the suction port 12*a*.

Figure 3:
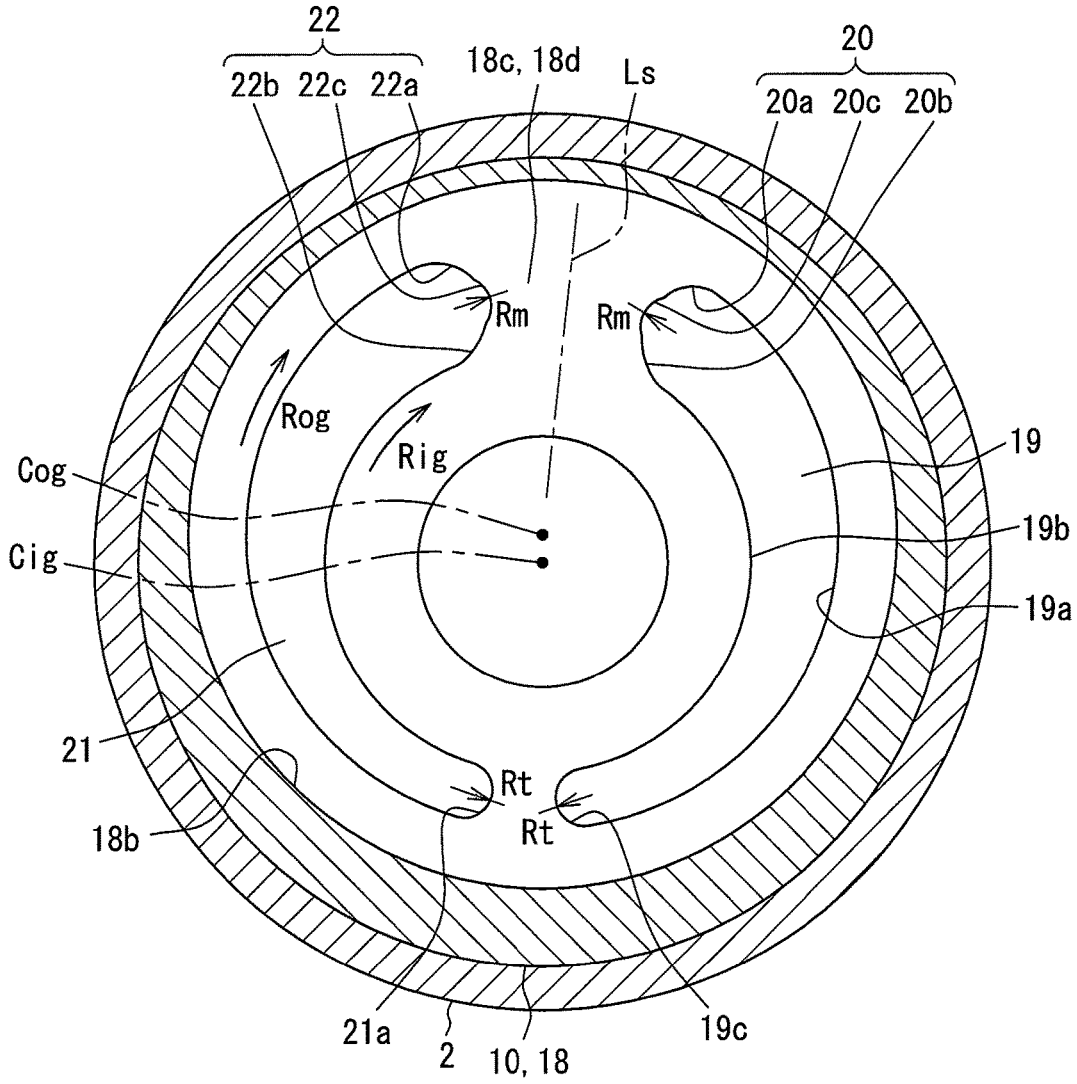
FIG. 3 is a cross-sectional view taken along a line III-III in FIG. 1 illustrating the pump body and the pump housing.
Figure 4:
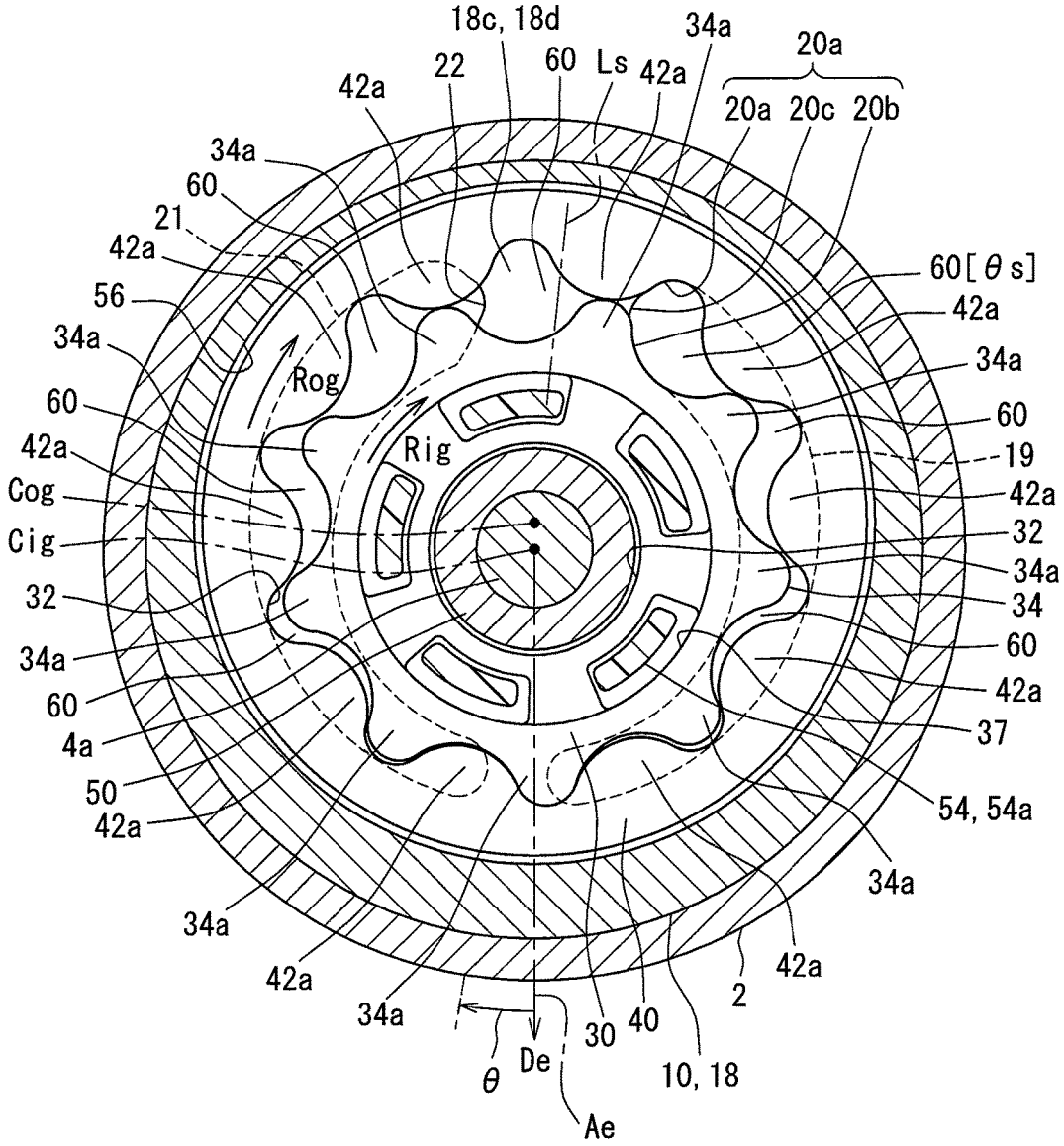
FIG. 4 is a cross-sectional view taken along a line IV-IV in FIG. 1.

The pump case 18 illustrated in FIGS. 1, 3, and 4 is formed from metal in a cylindrical shape having a bottom. An opening part 18*a* of the pump case 18 is covered by the pump cover 12 to be sealed along the entire circumference. As illustrated particularly in FIGS. 1 and 4, an inner peripheral part 18*b* of the pump case 18 is formed in a cylindrical hole shape that is eccentric from the inner central line Cig of the inner gear 30.

The pump case 18 includes a discharge passage 19 having an arc hole shape to discharge fuel from the discharge port 5*b* through a fuel passage 6 between the pump body 2 and the electric motor 4. The discharge passage 19 passes through a sliding surface 18*d*, which is a bottom surface of a recessed bottom part 18*c* of the pump case 18, along the axial direction. As illustrated particularly in FIG. 3, an inner peripheral extending part 19*b* of the discharge passage 19 extends to have a length smaller than half a circumference along the rotation direction Rig of the inner gear 30. An outer peripheral extending part 19*a* of the discharge passage 19 extends to have a length smaller than half a circumference along the rotation direction Rog of the outer gear 40. The discharge passage 19 is further narrowed from a discharge side end part 20 serving as a starting end part toward a terminal part 19*c* having a circular arc shape in the rotation directions Rig, Rog.

At the portion of the recessed bottom part 18*c* of the pump case 18 that is opposed to the suction passage 13 with a pump chamber 60 (described in detail later) between both the gears 30, 40 located therebetween, as illustrated particularly in FIG. 3, a suction groove passage 21 having a circular arc groove shape is formed corresponding to the shape of this suction passage 13 projected in the axial direction. Consequently, in the pump case 18, the outline of the discharge passage 19 is provided to be nearly symmetrical to the outline of the suction groove passage 21 with respect to a line. Thus, the suction groove passage 21 is further widened from a starting end part 21*a* having a circular arc shape toward a suction side end part 22 serving as a terminal part in the rotation directions Rig, Rog.

On the other hand, at the portion of the pump cover 12 that is opposed to the discharge passage 19 with the pump chamber 60 located therebetween as illustrated particularly in FIG. 2, a discharge groove passage 15 having a circular arc groove shape is formed corresponding to the shape of this discharge passage 19 projected in the axial direction. Consequently, in the pump cover 12, the outline of the suction passage 13 is provided to be nearly line-symmetrical to the outline of the discharge groove passage 15. Thus, the discharge groove passage 15 is further narrowed from a discharge side end part 16 serving as a starting end part toward a terminal part 15*a* having a circular arc shape in the rotation directions Rig, Rog.

In this manner, as the suction guide passages extending in the circumferential direction of the pump housing 10, the suction passage 13 and the suction groove passage 21 are formed to be recessed respectively from the corresponding sliding surfaces 12*b*, 18*d* of the pump housing 10, thereby suctioning fuel into the pump chamber 60. As the discharge guide passages extending in the circumferential direction of the pump housing 10, the discharge passage 19 and the discharge groove passage 15 are formed to be recessed respectively from the corresponding sliding surfaces 18*d*, 12*b* of the pump housing 10, thereby discharging fuel from the pump chamber 60.

As illustrated in FIG. 1, a radial bearing 50 is fitted and fixed to the recessed bottom part 18*c* of the pump case 18 on the inner central line Cig to radially bear the rotation shaft 4*a* of the electric motor 4. On the other hand, a thrust bearing 52 is fitted and fixed to the pump cover 12 on the inner central line Cig to axially bear the rotation shaft 4*a*.

As illustrated in FIGS. 1 and 4, in collaboration with the pump cover 12, the recessed bottom part 18*c* and the inner peripheral part 18*b* of the pump case 18 define an accommodating space 56 that accommodates the inner gear 30 and the outer gear 40. The inner gear 30 and the outer gear 40 are "trochoid gears" with the tooth shape curves of their respective teeth assuming a trochoid curve.

The inner gear 30 is disposed eccentrically in the accommodating space 56 with the inner gear 30 and the rotation shaft 4*a* having the inner central line Cig in common. An inner peripheral part 32 of the inner gear 30 is radially borne by the radial bearing 50 and is axially borne by the sliding surface 18*d* of the pump case 18 and the sliding surface 12*b* of the pump cover 12. The inner gear 30 includes insertion holes 37 along the axial direction. By inserting corresponding leg parts 54*a* of a joint member 54 respectively in these insertion holes 37, the inner gear 30 is connected to the rotation shaft 4*a* via the joint member 54. In this manner, in accordance with the rotation of the rotation shaft 4*a* by the electric motor 4, the inner gear 30 can rotate in the constant rotation direction Rig around the inner central line Cig.

The inner gear 30 includes outer teeth 34*a*, which are arranged side by side at regular intervals in this rotation direction Rig, at its outer peripheral part 34. The respective outer teeth 34*a* can be axially opposed to the passages 13, 19 and the groove passages 15, 21 in accordance with the rotation of the inner gear 30. Thus, sticking of the outer teeth 34*a* to the sliding surfaces 12*b*, 18*d* is limited.

The outer gear 40 is eccentric relative to the inner central line Cig of the inner gear 30 to be located coaxially in the accommodating space 56. Consequently, the inner gear 30 is eccentric relative to the outer gear 40 in an eccentric direction De as one radial direction. An outer peripheral part 44 of the outer gear 40 is radially borne by the inner peripheral part 18*b* of the pump case 18, and is axially borne by the sliding surface 18*d* of the pump case 18 and the sliding surface 12*b* of the pump cover 12. Because of these bearings, the outer gear 40 can rotate in the constant rotation direction Rog around an outer central line Cog that is eccentric from the inner central line Cig.

The outer gear 40 includes inner teeth 42*a*, which are arranged side by side at regular intervals in this rotation direction Rog, at its inner peripheral part 42. The number of inner teeth 42*a* of the outer gear 40 is set to be more than the number of outer teeth 34*a* of the inner gear 30 by one tooth. The respective inner teeth 42*a* can be axially opposed to the passages 13, 19 and the groove passages 15, 21 in accordance with the rotation of the outer gear 40. Thus, sticking of the inner teeth 42*a* to the sliding surfaces 12*b*, 18*d* is limited.

As illustrated in FIG. 4, the inner gear 30 is engaged with the outer gear 40 due to its eccentricity relative to the outer gear 40 in the eccentric direction De. Consequently, the pump chambers 60 are continuously formed between both the gears 30 and 40 in the accommodating space 56. The volume of this pump chamber 60 is expanded or contracted by the rotation of the outer gear 40 and the inner gear 30.

Specifically, the volume of the pump chamber 60 that is opposed to and communicates with the suction passage 13 and the suction groove passage 21 increases in accordance with the rotation of both the gears 30 and 40. As a consequence, fuel is drawn into the pump chamber 60 through the suction passage 13 from the suction port 12*a*. In this case, the suction passage 13 is further widened from the starting end part 13*c* toward the suction side end part 14 (see also FIG. 2). Thus, the amount of fuel drawn in through the suction passage 13 accords with the volume expansion amount of the pump chamber 60.

The volume of the pump chamber 60 that is opposed to and communicates with the discharge passage 19 and the discharge groove passage 15 decreases in accordance with the rotation of both the gears 30 and 40. As a consequence, fuel is discharged from the pump chamber 60 into the fuel passage 6 through the discharge passage 19 at the same time as the above suction function. In this case, the width of the discharge passage 19 is further reduced from the discharge side end part 20 toward the terminal part 19*c* (see also FIG. 3). Thus, the amount of fuel discharged through the discharge passage 19 accords with the volume contraction amount of the pump chamber 60.

In this manner, fuel is suctioned sequentially into the pump chambers 60 and is discharged from the pump chambers 60 by the fuel pump 100, and the fuel pressure on the discharge passage 19-side and the discharge groove passage 15-side is in a higher-pressure state than the fuel pressure on the suction passage 13-side and the suction groove passage 21-side.

A reference axis Ae is defined as the eccentric direction De of the inner gear 30 relative to the outer gear 40, and a deviation angle θ from the reference axis Ae is defined in the rotation direction Rig of the inner gear 30.

When the deviation angle θ for each pump chamber 60 reaches a predetermined start deviation angle θs due to the rotation of both the gears 30 and 40, the volume of the pump chamber 60 switches from its expansion and starts to contract. Thus, the contraction of each pump chamber 60 starts constantly at the same start deviation angle θs for the discharge passage 19 and the discharge groove passage 15 of the pump housing 10.

Figure 5:
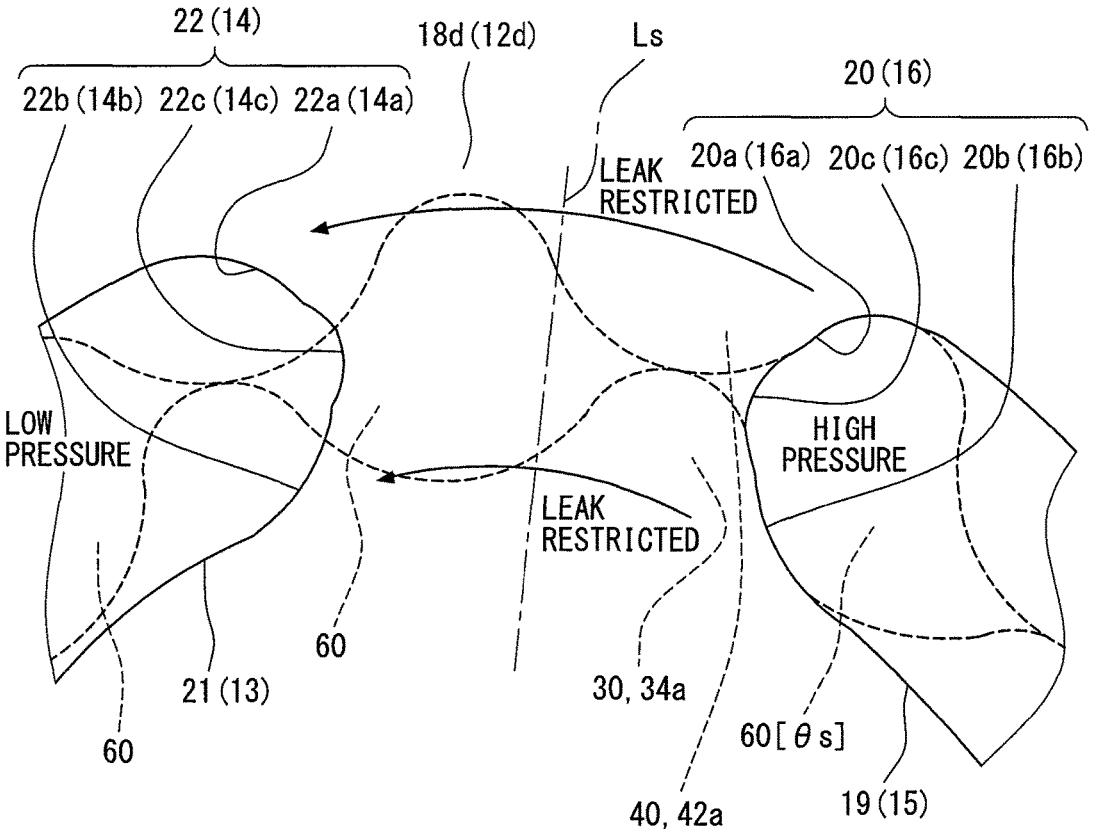
FIG. 5 is a schematic diagram illustrating a discharge side end part and a suction side end part of the embodiment.

The contour shape of the discharge side end part 20 of the discharge passage 19 and the contour shape of the discharge side end part 16 of the discharge groove passage 15 are related to the tooth shape at the start deviation angle θs. As specifically illustrated in FIGS. 4 and 5, the contours of outer peripheral parts 20*a*, 16*a* of the discharge side end parts 20, 16 at the start deviation angle θs are formed along the inner tooth 42*a* of the outer gear 40. More specifically, the outlines of the outer peripheral parts 20*a*, 16*a* are formed to be curved in a recessed shape along the tooth shape curve of the inner tooth 42*a*. At the same time, the contours of inner peripheral parts 20*b*, 16*b* of the discharge side end parts 20, 16 are formed along the outer tooth 34*a* of the inner gear 30. More specifically, the outlines of the inner peripheral parts 20*b*, 16*b* are formed to be curved in a recessed shape along the tooth shape curve of the outer tooth 34*a*.

The outlines of intermediate parts 20*c*, 16*c* of the discharge side end parts 20, 16 that respectively connect together the outer peripheral parts 20*a*, 16*a* and the inner peripheral parts 20*b*, 16*b* are formed to be curved in a recessed shape toward the suction side end parts 22, 14. In the present embodiment, curvature radiuses Rm of the intermediate parts 20*c*, 16*c* having a circular arc shape are configured to respectively correspond to curvature radiuses Rt of the terminal parts 19*c*, 15*a*. The pump chamber 60 that reaches the start deviation angle θs also reliably communicates with the discharge passage 19 and the discharge groove passage 15 near the intermediate parts 20*c*, 16*c*.

On the other hand, the outlines of the suction side end parts 14, 22 of the suction passage 13 and the suction groove passage 21 respectively have line-symmetric shapes of their corresponding discharge side end parts 16, 20 across a radial symmetrical line Ls in the direction of a predetermined deviation angle θ (e.g., 195°) from the center of the rotation shaft 4*a*, from each other. The suction side end part 22 of the suction groove passage 21 and the discharge side end part 20 of the discharge passage 19 are opposed to each other with a gap therebetween in the circumferential direction of the pump housing 10. Similarly, the suction side end part 14 of the suction passage 13 and the discharge side end part 16 of the discharge groove passage 15 are opposed to each other with a gap therebetween in the circumferential direction.

Because of these contour shapes, at the outer peripheral parts 20*a*, 16*a*, the discharge side end parts 20, 16 are located away respectively from the suction side end parts 22, 14 in the circumferential direction via the sliding surfaces 18*d*, 12*b* on which the inner teeth 42*a* of the outer gear 40 slide. At the inner peripheral parts 20*b*, 16*b*, the discharge side end parts 20, 16 are located away respectively from the suction side end parts 22, 14 in the circumferential direction via the sliding surfaces 18*d*, 12*b* on which the outer teeth 34*a* of the inner gear 30 slide.

On the pump case 18-side, the distance between the circumferentially-opposed intermediate parts 20*c*, 22*c* is smaller than the distance between the outer peripheral parts 20*a*, 22*a* and the distance between the inner peripheral parts 20*b*, 22*b*. Similarly, on the pump cover 12-side, the distance between the circumferentially-opposed intermediate parts 16*c*, 14*c* is also smaller than the distance between the outer peripheral parts 16*a*, 14*a* and the distance between the inner peripheral parts 16*b*, 14*b*. Particularly, the pump chamber 60 at the moment when the pump chamber 60 reaches the start deviation angle θs is indicated by 60 [θs] in FIGS. 4 and 5.

Figure 6:
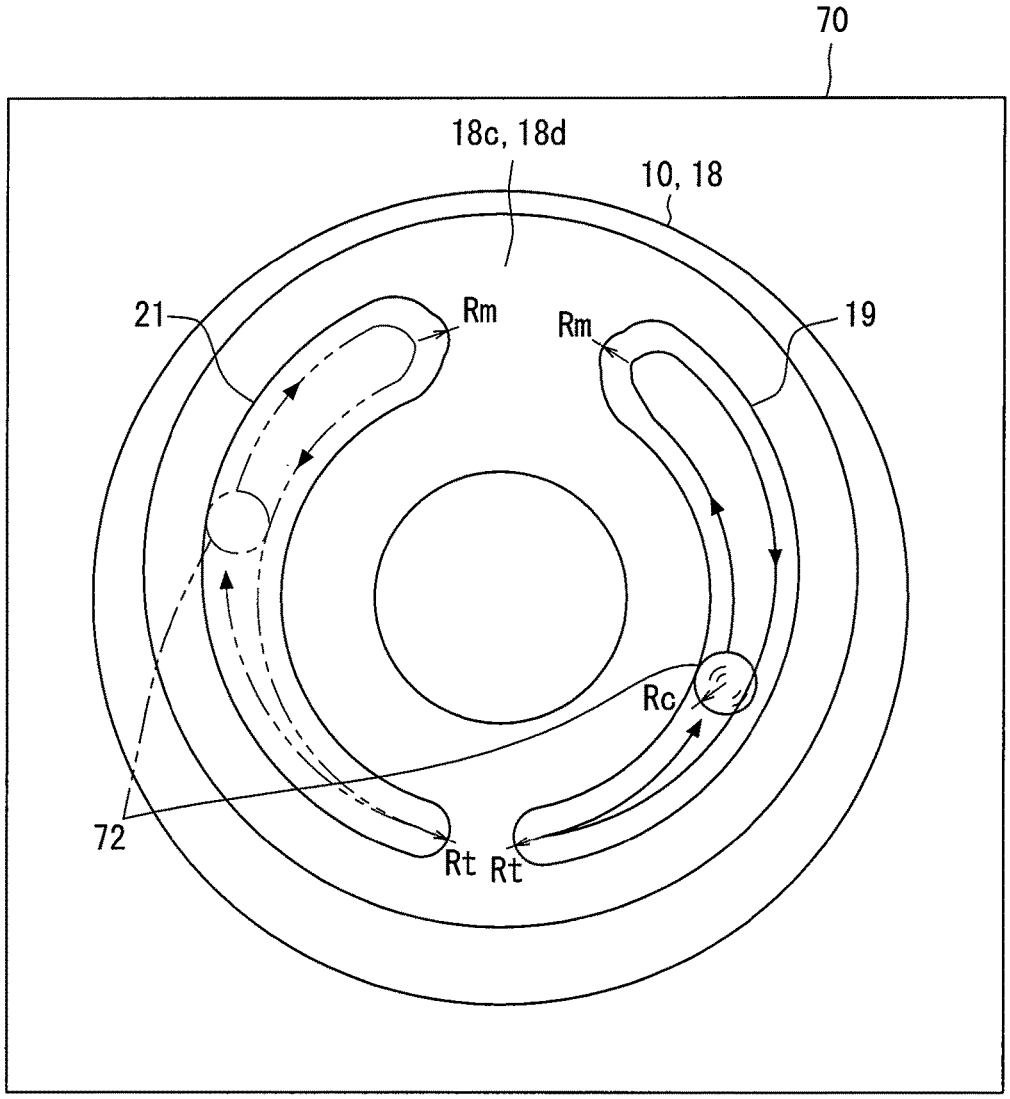
FIG. 6 is a schematic diagram illustrating a discharge guide passage cutting process and a suction guide passage cutting process of the fuel pump of the embodiment.

In the method of manufacturing such a fuel pump 100, particularly, the process of forming the passages 13, 19 and the groove passages 15, 21 serving as the guide passages will be briefly described with reference to FIG. 6. FIG. 6 illustrates the pump case 18-side as a representative, and the illustration of the pump cover 12-side is omitted.

The formation of the guide passages of the present embodiment is performed, for example, by controlling the operation of a working tool 72 of a machining center 70, to which the pump housing 10 is set, based on a computer program or the like. A cutter that rotates and cuts circularly is used for the working tool 72 of the present embodiment, and the cutting radius that substantially corresponds to the curvature radius Rm and the curvature radius Rt is selected for a cutting radius Rc of the working tool 72.

A discharge guide passage cutting process whereby to form the discharge passage 19 or the discharge groove passage 15 serving as the discharge guide passage in the pump housing 10 will be described below. Specifically, the discharge passage 19 is formed in the pump case 18 and the discharge groove passage 15 is formed in the pump cover 12. As for the formation of the discharge passage 19 in the pump case 18, the working tool 72 that rotates and cuts circularly is moved around in a single continuous line to form the outline of the discharge passage 19 including the discharge side end part 20. By cutting the pump case 18 to pass through the recessed bottom part 18*c* of the pump case 18 with this working tool 72, the discharge passage 19 is formed. As for the formation of the discharge groove passage 15 in the pump cover 12, the working tool 72 is moved around in a single continuous line to form the outline of the discharge groove passage 15 including the discharge side end part 16. By cutting the pump cover 12 to a predetermined depth from the sliding surface 12*b* with this working tool 72, the discharge groove passage 15 is formed.

A suction guide passage cutting process whereby to form the suction groove passage 21 or the suction passage 13 serving as the suction guide passage in the pump housing 10 will be described below. Specifically, the suction groove passage 21 is formed in the pump case 18 and the suction passage 13 is formed in the pump cover 12. As for the formation of the suction groove passage 21 in the pump case 18, the working tool 72 is moved around in a single continuous line to form the outline of the suction groove passage 21 including the suction side end part 22. By cutting the pump case 18 to a predetermined depth from the sliding surface 18*d* with this working tool 72, the suction groove passage 21 is formed. As for the formation of the suction passage 13 in the pump cover 12, the working tool 72 is moved around in a single continuous line to form the outline of the suction passage 13 including the suction side end part 14. By cutting the pump cover 12 to a predetermined depth from the sliding surface 12*b* with this working tool 72, the suction passage 13, in which the particular part Ss communicates with the suction port 12*a*, is formed.

The discharge guide passage cutting process and the suction guide passage cutting process are performed in no particular order. Moreover, the formation of the discharge groove passage 15 and the suction passage 13 in the pump cover 12 may be performed after the formation of the discharge passage 19 and the suction groove passage 21 in the pump case 18. Furthermore, the formation of the discharge passage 19 and the suction groove passage 21 in the pump case 18 may be performed in a certain machining center 70, and the formation of the discharge groove passage 15 and the suction passage 13 in the pump cover 12 may be performed in another machining center 70. In addition, a working tool 72 of a composite lathe or the like may be used instead of the machining center 70.

The operation and effects of the above-described present embodiment will be described below.

In the present embodiment, the outer peripheral parts 20*a*, 16*a* of the discharge side end parts 20, 16 are formed along the inner tooth 42*a* of the outer gear 40 at the deviation angle θs at which the decrease of the pump chamber 60 is started. At the same time, the inner peripheral parts 20*b*, 16*b* of the discharge side end parts 20, 16 are formed along the outer tooth 34*a* of the inner gear 30 at the deviation angle θs at which the decrease of the pump chamber 60 is started. As a result of the discharge passage 19 and the discharge groove passage 15 including the outer peripheral parts 20*a*, 16*a* and the inner peripheral parts 20*b*, 16*b*, the discharge of fuel into the discharge passage 19 is started smoothly when the reduction of the pump chamber 60 starts. Thus, the pulsation is restricted, so that both the gears 30 and 40 can smoothly rotate. Moreover, the outer peripheral parts 20*a*, 16*a* and the inner peripheral parts 20*b*, 16*b* of the discharge side end parts 20, 16 are located away from the suction side end parts 22, 14 with respective gaps therebetween in the circumferential direction. This can limit the leakage of fuel from the discharge passage 19 via the sliding surface 18*d* to the suction groove passage 21, or from the discharge groove passage 15 via the sliding surface 12*b* to the suction passage 13. Thus, the fuel pump 100 with high pump efficiency can be provided.

In the present embodiment, the intermediate parts 20*c*, 16*c* of the discharge side end parts 20, 16 that connect together the outer peripheral parts 20*a*, 16*a* and the inner peripheral parts 20*b*, 16*b* are formed to be curved in a projecting shape toward the suction side end parts 22, 14. The outer peripheral parts 20*a*, 16*a* and the inner peripheral parts 20*b*, 16*b* are connected by these intermediate parts 20*c*, 16*c* to make the entire discharge side end parts 20, 16 approximate the shapes of both the gears 30 and 40. Thus, the discharge of fuel into the discharge passage 19 starts smoothly to enhance the pump efficiency.

The suction side end parts 22, 14 of the present embodiment have the line-symmetric shapes of the discharge side end parts 20, 16, respectively. Because of these suction side end parts 22, 14, the outer peripheral parts 20*a*, 16*a* and the inner peripheral parts 20*b*, 16*b* of the discharge side end parts 20, 16 are reliably distanced from the suction side end parts 22, 14, respectively to enhance the effect of restricting the fuel leak.

According to the present embodiment, on the pump housing 10, the working tool 72 that rotates and cuts circularly is moved around in a single continuous line to form the contour of the discharge passage 19 including the discharge side end part 20 or the contour of the discharge groove passage 15 including the discharge side end part 16, so that the discharge passage 19 or the discharge groove passage 15 is formed. In such a process, the discharge passage 19 or the discharge groove passage 15 can be formed without changing the working tool 72, thereby limiting the development of burr or the like that can be caused in the case of changing the working tool 72. This can facilitate the production of the fuel pump 100 including the outer peripheral part 20*a* or 16*a* along the inner tooth 42*a*, and the inner peripheral part 20*b* or 16*b* along the outer tooth 34*a*. The productivity can be improved by also forming the suction groove passage 21 or the suction passage 13 similarly.

In the fuel pump 100 which is produced in this manner, the fuel smoothly starts to be discharged into the discharge passage 19 upon start of the decrease of the pump chamber 60. Thus, the pulsation can be restrained to smoothly rotate both the gears 30 and 40. Moreover, the outer peripheral parts 20*a*, 16*a* and the inner peripheral parts 20*b*, 16*b* of the discharge side end parts 20, 16 are located away from the suction side end parts 22, 14 with respective spaces therebetween in the circumferential direction. This can limit the leakage of fuel from the discharge passage 19 via the sliding surface 18*d* to the suction groove passage 21, or from the discharge groove passage 15 via the sliding surface 12*b* to the suction passage 13. Therefore, the fuel pump 100 with high pump efficiency can be produced easily.

The embodiment has been described above. The present disclosure is not interpreted by limiting to this embodiment, and can be applied to various embodiments without departing from the scope of the disclosure. Modifications to the above embodiment will be described below.

Specifically, the curvature radius Rm and the curvature radius Rt do not need to be the same for one guide passage in a first modification. The curvature radiuses Rm, Rt do not need to be the same as the cutting radius Rc of the working tool 72.

In a second modification, the intermediate parts 20*c*, 16*c* of the discharge side end parts 20, 16 that connect together the outer peripheral parts 20*a*, 16*a* and the inner peripheral parts 20*b*, 16*b* are not necessarily formed to be curved in a recessed shape toward the suction side end parts 22, 14. For example, a straight line portion may be included in each of the intermediate parts 20*c*, 16*c*.

The suction side end parts 22, 14 of a third modification do not necessarily have the line-symmetric shapes of the discharge side end parts 20, 16, respectively. For example, a straight line portion may be included only in the suction side end parts 22, 14.

In a fourth modification, the formation of the passages 13, 19 and the groove passages 15, 21 may be performed by methods (e.g., forging) other than cutting work.

Figure 7:
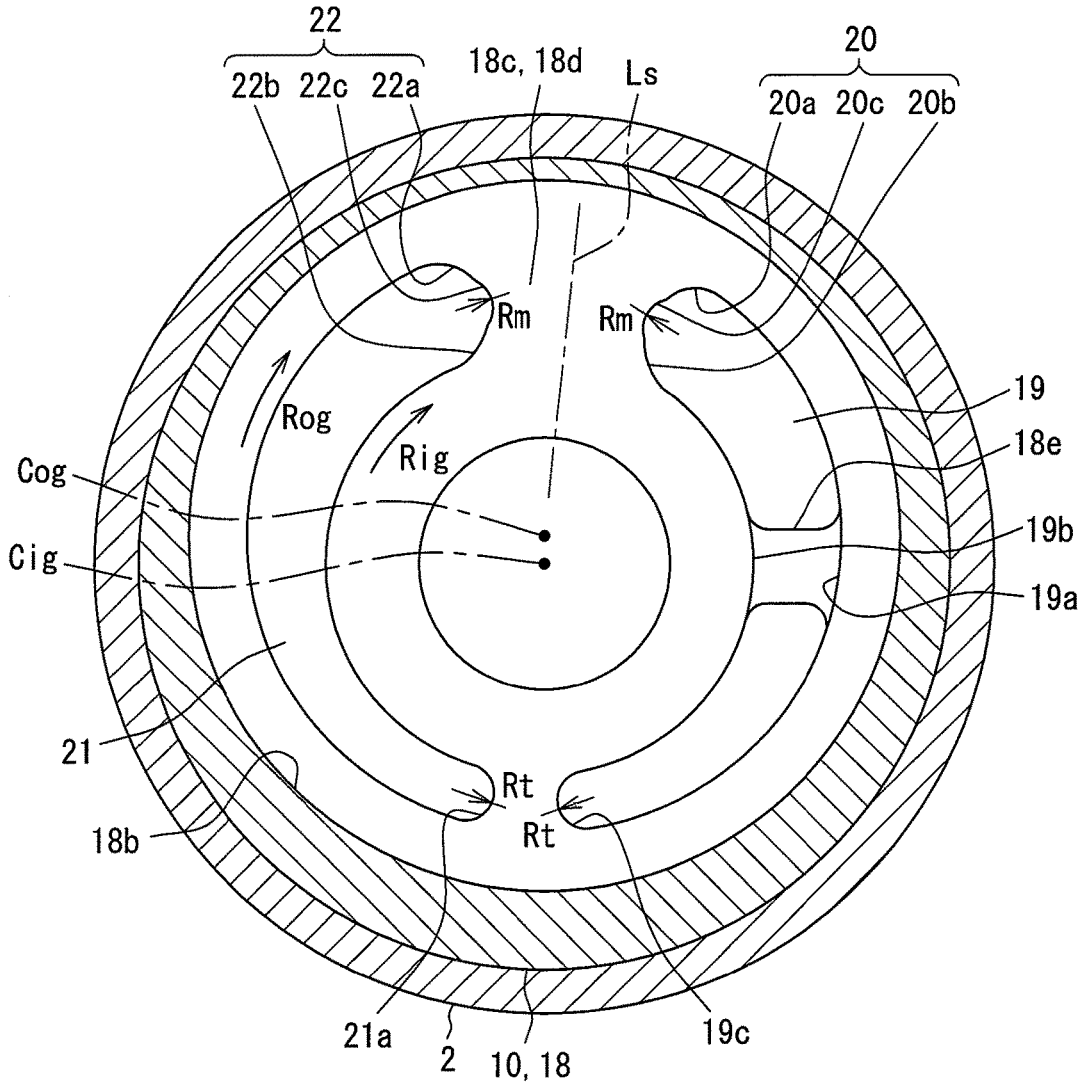
FIG. 7 is a diagram corresponding to FIG. 3 in a fifth modification.

In a fifth modification, a reinforcing rib 18*e* that bridges over the discharge passage 19 to reinforce the pump case 18 may be provided generally at the center of the discharge passage 19 as illustrated in FIG. 7.

The fuel pump 100 in a sixth modification may suction and discharge gasoline other than light oil, or liquid fuel equivalent thereto, as its fuel.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

The invention claimed is:

1. A fuel pump comprising:

an outer gear that includes a plurality of inner teeth;

an inner gear that includes a plurality of outer teeth and is eccentric from the outer gear in an eccentric direction to be engaged with the outer gear; and a pump housing that rotatably accommodates the outer gear and the inner gear, wherein:

the outer gear and the inner gear expand and contract volume of a plurality of pump chambers formed between both the gears, and rotate to sequentially suction fuel into the plurality of pump chambers and discharge fuel from the plurality of pump chambers;

the pump housing includes:

a sliding surface on which the outer gear and the inner gear slide;

a suction guide passage that suctions fuel into the plurality of pump chambers as a guide passage that is recessed from the sliding surface and extends in a circumferential direction of the pump housing; and a discharge guide passage that discharges fuel from the plurality of pump chambers as the guide passage that is recessed from the sliding surface and extends in the circumferential direction;

a suction side end part of the suction guide passage and a discharge side end part of the discharge guide passage are opposed to each other with a gap therebetween; and at a deviation angle at which the contraction of each of the plurality of pump chambers starts, an outer peripheral part of the discharge side end part is formed along a corresponding one of the plurality of inner teeth, and an inner peripheral part of the discharge side end part is formed along a corresponding one of the plurality of outer teeth.

2. The fuel pump according to claim 1, wherein an intermediate part of the discharge side end part that connects together the outer peripheral part and the inner peripheral part is formed to be curved in a recessed shape toward the suction side end part.

3. The fuel pump according to claim 1, wherein the suction side end part has a line-symmetric shape of the discharge side end part.

4. A method of manufacturing the fuel pump recited in claim 3, comprising:

performing a discharge guide passage cutting process, in which a working tool that rotates and cuts circularly is moved around on the pump housing in a single continuous line to form an outline of the discharge guide passage including the discharge side end part, thereby forming the discharge guide passage; and performing a suction guide passage cutting process, in which the working tool is moved around on the pump housing in a single continuous line to form an outline of the suction guide passage including the suction side end part, thereby forming the suction guide passage.

* * * * *